US009218789B1

(12) United States Patent
Lininger et al.

(10) Patent No.: US 9,218,789 B1
(45) Date of Patent: Dec. 22, 2015

(54) CORRECTING IMAGE POSITIONING DATA

(75) Inventors: Scott Lininger, Lafayette, CO (US); Dragomir Anguelov, Mountain View, CA (US)

(73) Assignee: Google Inc., Mountain View, CA (US)

( * ) Notice: Subject to any disclaimer, the term of this patent is extended or adjusted under 35 U.S.C. 154(b) by 836 days.

(21) Appl. No.: 13/244,799

(22) Filed: Sep. 26, 2011

Related U.S. Application Data

(63) Continuation of application No. 13/098,761, filed on May 2, 2011, now abandoned.

(51) Int. Cl.
*G09G 5/00* (2006.01)
*G09G 5/14* (2006.01)

(52) U.S. Cl.
CPC ..... *G09G 5/14* (2013.01); *G09G 2340/10* (2013.01)

(58) Field of Classification Search
USPC ..... 345/629
See application file for complete search history.

(56) References Cited

U.S. PATENT DOCUMENTS

| | | | | |
|---|---|---|---|---|
| 7,145,478 | B2 * | 12/2006 | Goncalves et al. | 340/995.1 |
| 7,573,403 | B2 * | 8/2009 | Goncalves et al. | 340/995.1 |
| 7,774,158 | B2 * | 8/2010 | Domingues Goncalves et al. | 702/152 |
| 2004/0167670 | A1 * | 8/2004 | Goncalves et al. | 700/259 |
| 2004/0168148 | A1 * | 8/2004 | Goncalves et al. | 717/104 |
| 2007/0262884 | A1 * | 11/2007 | Goncalves et al. | 340/995.24 |
| 2008/0024484 | A1 * | 1/2008 | Naimark | 345/419 |
| 2008/0082264 | A1 | 4/2008 | Hill et al. | |
| 2008/0204317 | A1 | 8/2008 | Schreve et al. | |
| 2009/0100342 | A1 | 4/2009 | Jakobson | |
| 2009/0232506 | A1 * | 9/2009 | Hudson et al. | 398/106 |
| 2010/0191459 | A1 * | 7/2010 | Carter et al. | 701/208 |
| 2010/0214284 | A1 * | 8/2010 | Rieffel et al. | 345/419 |
| 2011/0187704 | A1 * | 8/2011 | Chen et al. | 345/419 |
| 2011/0187716 | A1 * | 8/2011 | Chen et al. | 345/427 |

OTHER PUBLICATIONS

Google maps, URL:http://www.google.com/help/maps/streetview Retrieved from the Internet on Apr. 21, 2011.

* cited by examiner

*Primary Examiner* — M Good Johnson
(74) *Attorney, Agent, or Firm* — Lerner, David, Littenberg, Krumholz & Mentlik, LLP

(57) ABSTRACT

An image positioning system provides an interactive visualization that includes a representation of a geographic area and several camera pose indicators, each of which indicates a location within the geographic area at which a corresponding image was obtained. An operator may select one a pose indicators and adjust the position of the pose indicator relative to the representation of the geographic area. In response, the image positioning system may automatically generate a corrected location at which the image corresponding to the selected pose indicator was obtained. The corrected location then may be stored in a database and used for various applications that utilize image positioning data.

21 Claims, 11 Drawing Sheets

CORRECTING IMAGE POSITIONING DATA

CROSS-REFERENCE TO RELATED APPLICATION

This application is a continuation of and claims priority to U.S. patent application Ser. No. 13/098,761, filed on May 2, 2011, and entitled "Correcting Image Positioning Data," the entire disclosure of which is hereby expressly incorporated by reference herein.

FIELD OF THE DISCLOSURE

This disclosure relates to determining and adjusting positioning data with which an image, such as a photograph of a street, is associated.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Many images, such as photographs and video recordings, are stored with metadata that indicates the geographic location at which the image was created. For example, a camera equipped with a Global Positioning Service (GPS) receiver determines the position of the camera in the GPS coordinate system at the time a photograph is taken and stores the determined GPS coordinates with the photograph. These coordinates later can be used to determine what is depicted in the photograph (e.g., which building in what city), for example.

However, in some situations, metadata stored with an image fails to indicate the geographic location with the desired precision. For example, GPS generally has a margin of error of approximately 25 meters. In so-called "urban canyons," or city locations at which tall buildings obscure or reflect GPS signals, the problem of imprecise coordinates is particularly prevalent.

SUMMARY

In an embodiment, image pose data that indicates respective geographic locations at which a plurality of images were obtained is stored on a computer-readable medium. A method for correcting the image pose data includes causing a representation of a geographic area to be displayed on a display device, determining a respective position of each of a plurality of pose indicators relative to the representation of the geographic area based on the respective geographic locations in the image pose data, causing the plurality of pose indicators to be displayed over the representation of the geographic area on the display in accordance with the determined respective positions, receiving an indication of a modified position of a selected one of the plurality of pose indicators relative to the representation of the geographic area on the display device, determining a corrected geographic location at which the one of the plurality of images was obtained based on the received indication of the modified position, and modifying the pose data in accordance with the corrected geographic location. According to the embodiment, each of the plurality pose indicators corresponds to a respective one of the plurality of images.

In another embodiment, an image positioning system includes a database to store a plurality pose records, where each of the plurality of pose records includes an image and pose data to indicate a geographic location at which the image was obtained. The image positioning system also includes a pose rendering engine communicatively coupled to the database and configured to generate a representation of a geographic area to be displayed at a client device, determine a respective position of each of a plurality of pose indicators relative to the representation of the geographic area based on the respective geographic locations in the respective pose records, and generate a representation of the plurality of pose indicators to be displayed over the representation of the geographic area at the client device in accordance with the determined respective positions. Each of the plurality pose indicators corresponds to a respective one of the plurality of images. The image positioning system further includes a pose calculation engine configured to, in response to receiving an indication that an operator modified a position of a selected one of the plurality of pose indicators relative to the representation of the geographic area at the client device, determine a corrected geographic location at which the image corresponding to the selected one of the plurality of poses was obtained based on the modified position of the selected one of the plurality of pose indicators, and modify the corresponding one of the plurality of pose records in accordance with the corrected geographic location.

In another embodiment, instructions executable by one or more processors are stored on a tangible non-transitory computer-readable medium. When executed by the one or more processors, the instructions cause the one or more processors to cause a representation of a geographic area to be displayed on a display device, determine a respective position of each of a plurality of pose indicators relative to the representation of the geographic area based on the respective geographic locations in the image pose data, cause the plurality of pose indicators to be displayed over the representation of the geographic area on the display in accordance with the determined respective positions, receive an indication of a modified position of a selected one of the plurality of pose indicators relative to the representation of the geographic area on the display device, determine a corrected geographic location at which the one of the plurality of images was obtained based on the received indication of the modified position, and modify the pose data in accordance with the corrected geographic location. Each of the plurality pose indicators corresponds to a respective one of the plurality of images, according to the embodiment.

DETAILED DESCRIPTION

Figure 1:
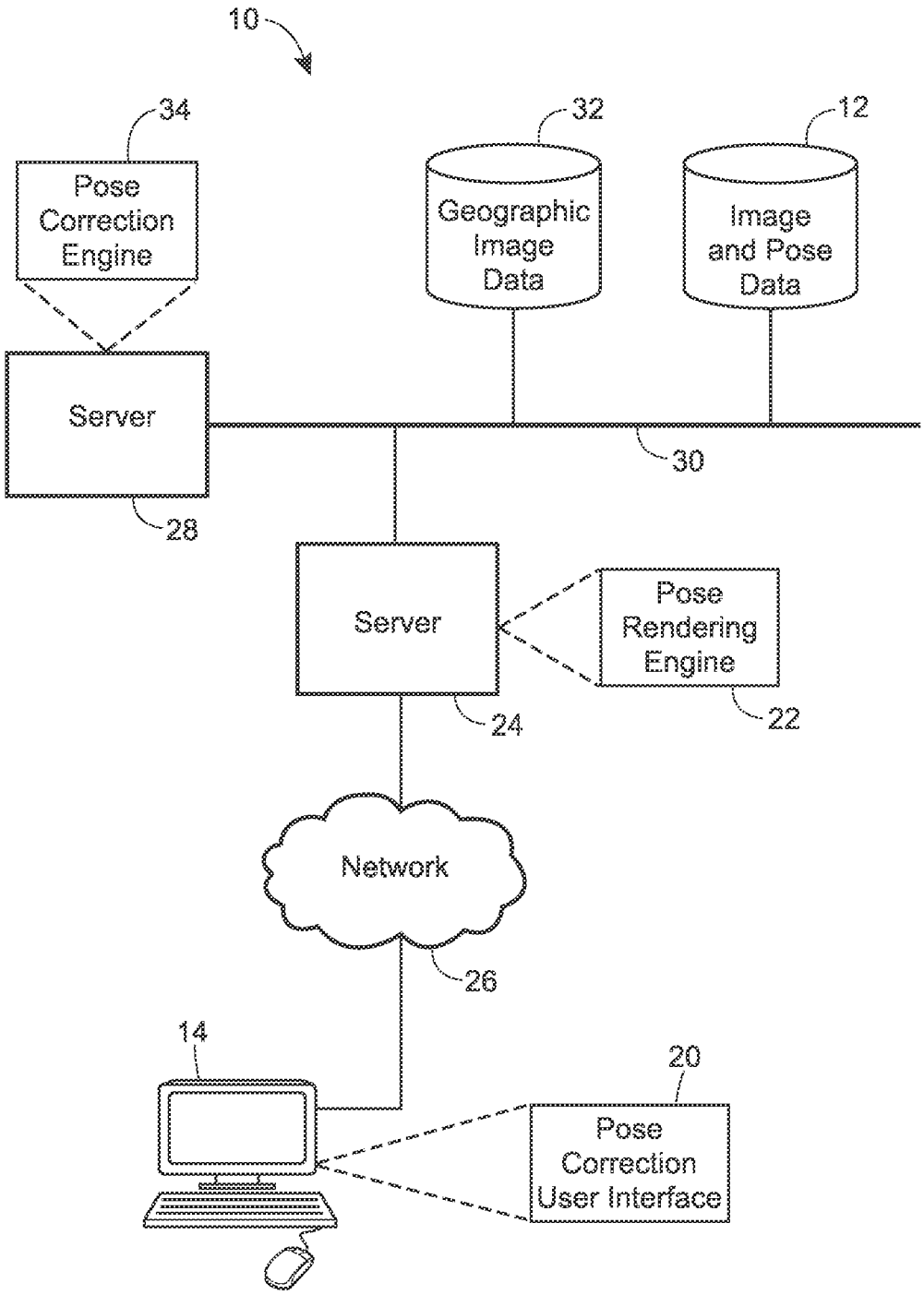
FIG. 1 is a block diagram of an image positioning system in which pose correction techniques of the present disclosure are utilized to adjust location data for selected images.

FIG. 1 illustrates an image positioning system 10 in which an operator adjusts camera positioning data for selected images, collected along a certain path, using an interactive visualization that includes satellite imagery, a street map, a topographic map, or another type of a representation of a geographic area. Positioning data of an image, which sometimes indicates both the geographic location of the camera and the orientation of the camera relative to one or several axis at the time the image is captured, is referred to herein as "a camera pose" or just "a pose."

Generally speaking, the interactive visualization includes one or more pose indicators, such as pictograms, representing poses in the corresponding locations in the geographic area. The interactive visualization is displayed via a user interface that includes a display device and an input device, for example. The operator uses the pose indicators to select one or more poses that appear to be in wrong locations and, when appropriate, moves the selected poses to the locations in the geographic area where the operator believes the corresponding images likely were obtained. For example, the operator may see that a pose indicator representing a pose that is associated with a certain position of a vehicle is rendered over an image of a building, and conclude that the pose is likely incorrect. The operator may then adjust the position of the pose indicator in the interactive visualization so as to place the corresponding pose into a nearby location in a street. In some cases, the operator may also inspect one or more images associated with a certain pose to more accurately determine whether and how the pose should be adjusted. In response to the user adjusting the location of a pose indicator in the interactive visualization, or accepting as valid the currently displayed location of the pose indicator, the corresponding pose is updated. For example, if the pose includes GPS coordinates, new GPS coordinates may be automatically calculated and stored in accordance with the updated location to which the operator has moved the pose indicator.

According to an example scenario, a camera mounted on a vehicle traveling along a certain path periodically photographs the surrounding area and obtains pose data, such as GPS coordinates, for each photograph. A series of camera poses collected along the path corresponds to the trajectory of the vehicle, and is referred to herein as a "pose run." The photographs and the corresponding poses are then uploaded to an image and pose database 12. The images and poses stored in the pose database 12 may be used to provide on demand street-level views of geographic regions, for example, or in other applications. However, because GPS coordinates are not always accurate, one or more operators may use the image positioning system 10 to verify and, when needed, adjust poses of some of the images stored in the database 12.

To select and adjust one or more poses in a pose run, the operator may use a computing device 14 that implements a pose correction user interface (UI) component 20. In general, the pose correction UI component 20 displays a visualization of a geographic area and a representation of a pose run superimposed on the visualization of the geographic area on a display device. To represent a pose run, the pose correction UI component 20 may display pose indicators (e.g., graphic symbols such as circles, alphanumeric symbols, images, etc.) at the locations on the map corresponding to the poses and, in an embodiment, also display lines or arrows interconnecting consecutive pose indicators to illustrate the path the camera has travelled. The pose correction UI component 20 allows the operator to select and reposition the pose by dragging the corresponding pose indicator over to the desired location on the map, for example. In response to the user repositioning one or several pose indicators, the pose correction UI component 20, or another software component executing in the computing device 20, forwards the updated pose information to a pose rendering engine 22 for further processing.

In an embodiment, the pose rendering engine 22 operates in a front-end server 24 to which the pose rendering engine 22 is communicatively coupled via a network 26. The front-end server 24 in turn may be communicatively coupled to the image and pose database 12, one or several back-end servers 28 in which corresponding instances of a pose correction engine 34 operate, and a geographic image database 32 via a communication link 30. In this embodiment, the computing device 14 operates as a client device that receives geographic area data, pose data, etc. from the front-end server 24 and the back-end server 28. During operation, the pose rendering engine 22 may report pose corrections received from the pose correction UI component 20 to the pose correction engine 34, receive updated pose run data from the pose correction engine 34, and provide an updated visualization of the geographic area and the pose run to the pose correction UI component 20. The pose correction engine 34 may process the pose corrections received from the pose rendering engine 22 and, when appropriate, update the image and pose database 12. For example, the pose correction engine 34 may determine whether a pose correction submitted by an operator is within an allowable range and whether the pose correction conflicts with another pose correction, submitted by another operator at the same time or previously. Further, in some embodiments, the pose correction engine 34 automatically adjusts one or more poses in a pose run (e.g., poses 2, 3, 4, and 5) based on the received corrections to one or more other poses in the same pose run (e.g., poses 1 and 6). Still further, the pose correction engine 34 may analyze pose data adjusted or accepted by an operator to detect pose trends, such as a consistent "drift" in the originally stored GPS coordinates, for example. In an embodiment, the pose correction engine 34 utilizes the detected trends in automatic correction of pose data.

In an embodiment, the pose correction UI component 20 prompts the operator for authentication information (e.g., login and password) prior to granting the operator access to pose data stored in the image and pose database 12.

In general, the functionality of the pose correction UI component 20, the pose rendering engine 22, and the pose correction engine 34 can be distributed among various devices operating in the image positioning system 10 in any suitable manner. For example, if desired, both the pose rendering engine 22 and the pose correction engine 34 can be implemented in a single device such as the front-end server 24. As another example, the pose correction UI component 20, the pose rendering engine 22, and the pose correction engine 34 can be implemented in a single computing device such as a PC. As yet another example, the rendering of a geographic area and a pose run mapped onto the geographic area can be implemented in the computing device 14. In one such embodiment, a browser plug-in is installed in the computing device 14 to support the necessary rendering functionality. In another embodiment, the pose correction UI component 20 is provided in a separate application executing on the computing device 14.

Depending on the implementation, the network 26 may be the Internet, an intranet, or any other suitable type of a network. The communication link 30 may be an Ethernet link or another type of a wired or wireless communication link. Further, as discussed in more detail below, the computing device 14 may be a desktop personal computer (PC), a laptop PC, a tablet PC, a mobile device such as a smartphone, etc.

Next, an example data structure that may be used to store and process image and pose data for use in the image positioning system 10 is described with reference to FIG. 2, followed by a discussion of the user interface supported by the image positioning system 10, as well as various features of the image positioning system 10 accessible via the pose correction UI 22, with reference to FIGS. 3-7. In particular, FIGS. 3-7 illustrate several example interactive screens that may be displayed on a display device and using which an operator may verify and adjust image pose data.

Figure 2:
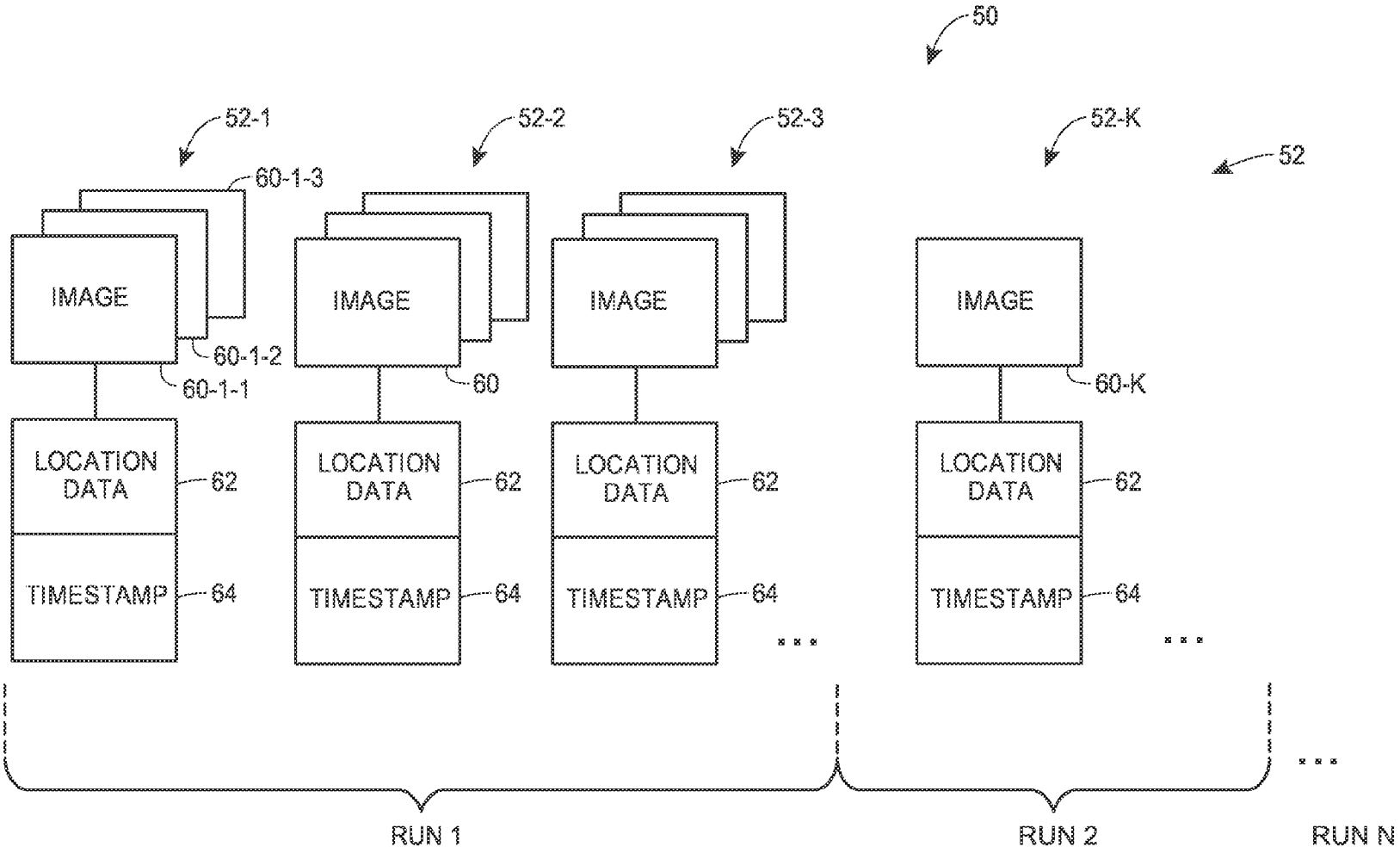
FIG. 2 is a block diagram of an example data structure that may be used in the image positioning system of FIG. 1 to store images and the associated metadata.

First referring to FIG. 2, a data structure 50 may include several pose records 52, (i.e., pose records 52-1, 52-2, . . . 52-K). The image and pose database 12 illustrated in FIG. 1, for example, may store the pose records 52 on a computer-readable medium. The pose records 52 may correspond to one or more pose runs 1, 2, . . . N, which may include the same number of pose records or different numbers of pose records, depending on the implementation. Each pose record 52 may include one or more images 60 and pose data such as location/positioning data 62 and a timestamp 64. For example, the pose records 52-1 includes images 60-1-1, 60-1-2, and 60-1-3, which may be photographs taken at the same time from the same point in space using cameras pointing in different directions. The pose records 52-2 and 52-3, generated during or following the same pose run, include similar sets of images. On the other hand, the pose record 52-K includes a single image 60-K, which may be a panoramic photograph, for example.

In an embodiment, the location data 62 includes GPS coordinates. In another embodiment, the location data 62 includes local positioning service (LPS) data such as an identifier of a proximate WiFi hotspot, for example. In general, the location data 62 can include any suitable indication of a location with which the one or several images 60 are associated.

The timestamp 64 stores time data in any suitable manner. For example, the timestamp 64 may indicate the year, the month, and the day the corresponding images were obtained. In some implementations, the timestamp 64 may additionally indicate the hour and the minute, for example. The timestamp 64 in other implementations may indicate a time relative to a certain event, e.g., the time the first photograph in the corresponding pose run is taken, or the timestamp 64 may be implemented as any other suitable type of a time metric.

Further, in some embodiments, images and poses may be sequentially labeled to simplify a reconstruction of the order in which the images were collected during a pose run. For example, a certain pose record 52 may include a sequence number (not shown) to indicate the order of each pose record 52 within a certain run i relative to other pose records 52 within the same run i. Still further, the pose records 52 may include pose run identifiers (not shown) to differentiate between the pose runs 1, 2, . . . N. Accordingly, in this embodiment, images collected during the same pose run may be assigned the same pose run identifier.

Still further, in an embodiment, the data structure 50 includes flags (not shown) indicating whether pose data has been verified and/or adjusted by one or more operators. For example, a binary flag may be set to a first value (e.g., logical "true") if the corresponding pose data has been verified, and to a second value (e.g., logical "false") if the corresponding pose data has not yet been verified. Depending on the implementation, each of the pose records 52 may include a record-specific flag, or flags may be set on a per-pose-run basis. In another embodiment, flags are implemented in a configuration database that is physically and/or logically separate from the image and pose database 12.

Figure 3:
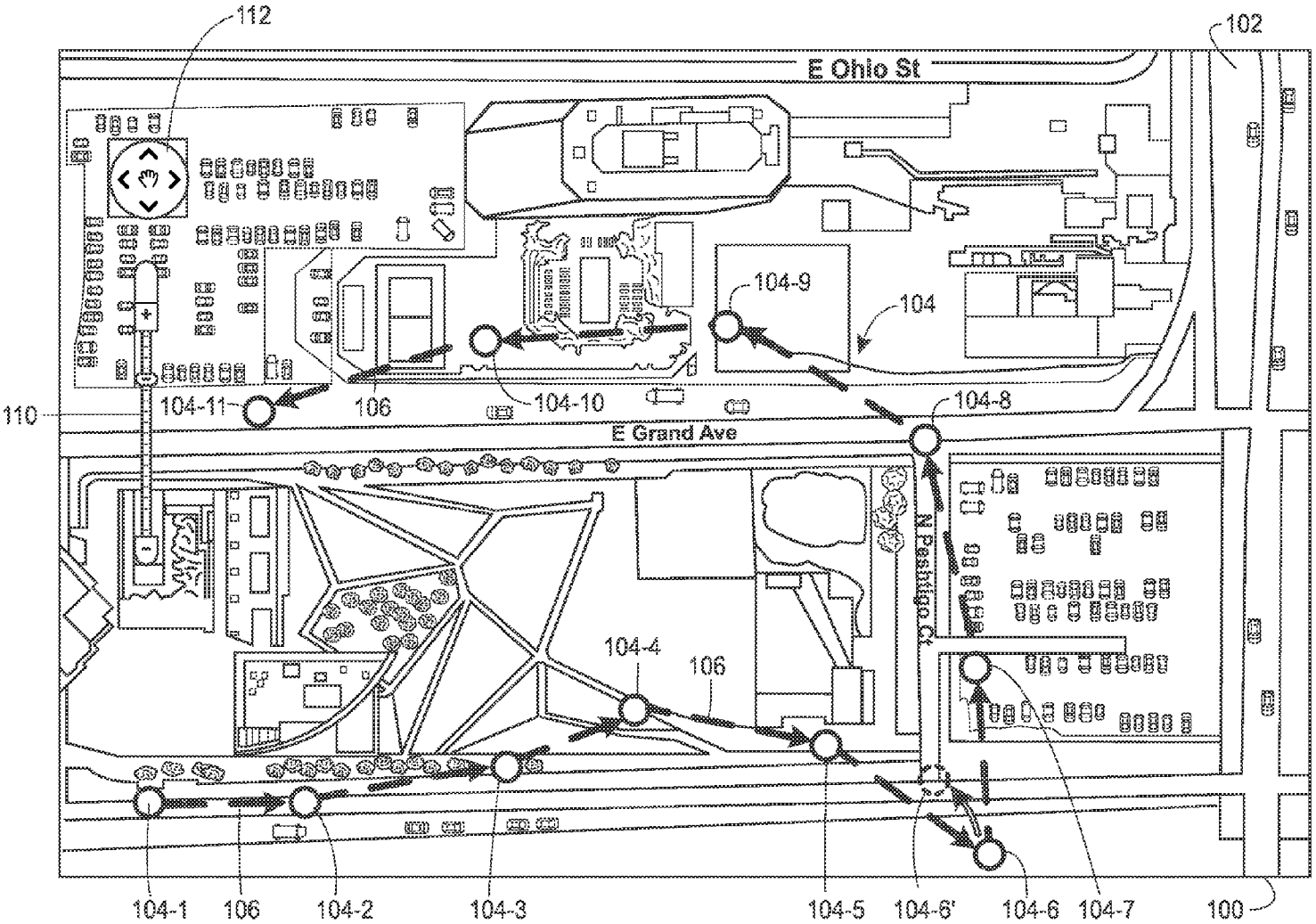
FIG. 3 is an example screenshot of a user interface via which an operator may adjust location data for images using the techniques of the present disclosure.
Figure 4:
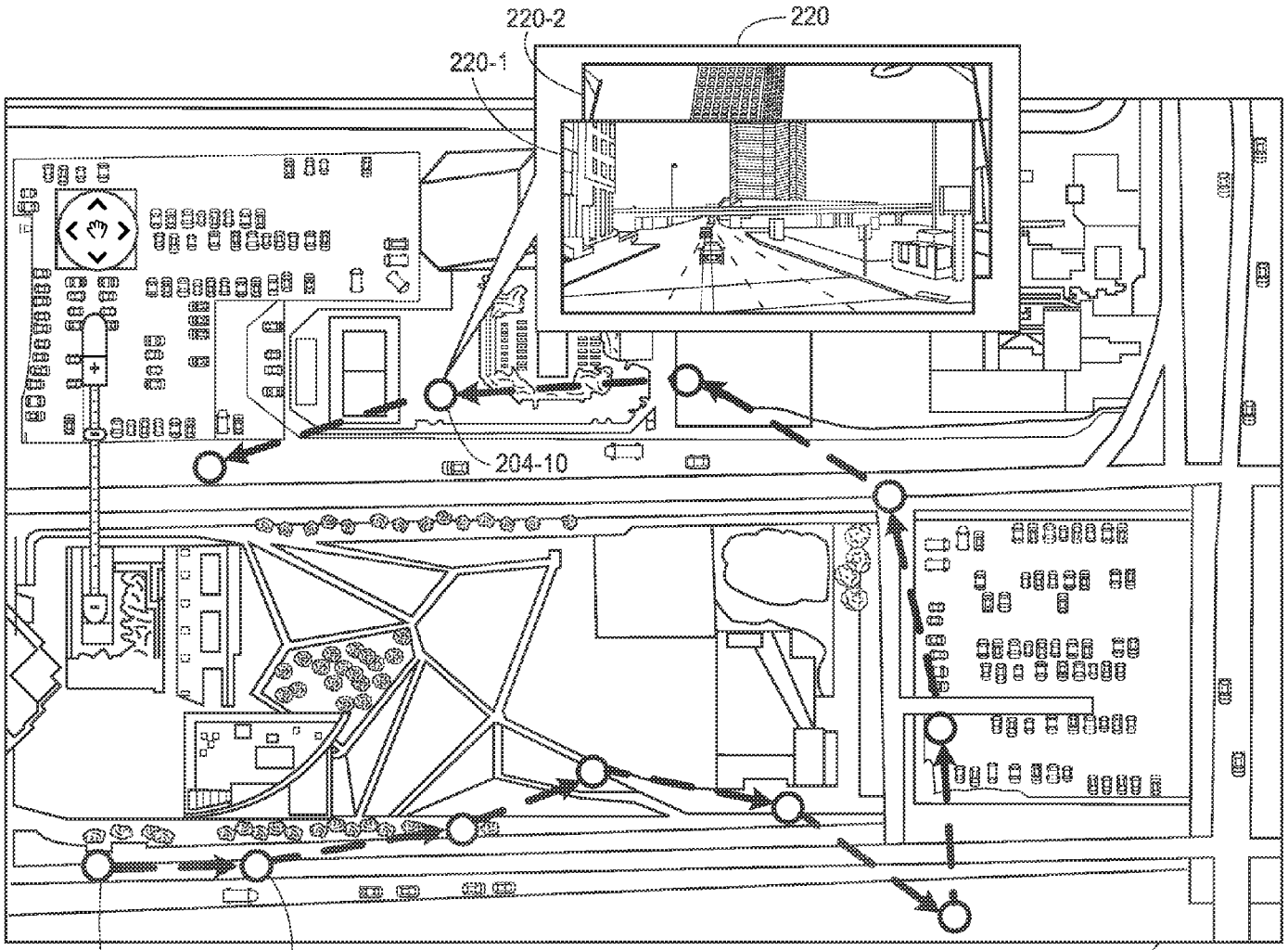
FIG. 4 is an example screenshot of a user interface via which an operator may view images and adjust location data for these images using the techniques of the present disclosure.

Now referring to FIG. 3, the pose correction UI component 20 may generate an interactive screen 100 to allow an operator to adjust image positioning data. Depending on the implementation, the interactive screen 100 may be displayed in a browser application, in a standalone application, or another type of an application. Further, depending on the configuration or the computing environment in which the software displaying the interactive screen 100 executes, the operator may interact with the interactive screen 100 using a mouse, a touchpad, a keyboard, a touch screen, a voice input device, or another suitable type of an input device.

In the example illustrated in FIG. 3, the interactive screen 100 includes a satellite image 102 of several city blocks, displayed in the background, and a series of pose indicators 104 (i.e., 104-1, 104-2, . . . 104-L) displayed in the foreground. In this example, the number of pose indicators L is eleven. In general, however, any number of pose indicators 104 can be simultaneously displayed in the interactive screen 100 or a similar interactive screen. The pose indicators 104-1, 104-2, . . . 104-L are displayed according to the corresponding pose data, e.g., the GPS coordinates stored in the pose data. For example, referring back to FIG. 2, each of the pose indicators 104-1, 104-2, . . . 104-L may be superimposed on the satellite image 102 according to the information in the location data field 62 in the corresponding pose data record 52. Arrows 106 interconnect the pose indicator 104-1, 104-2, . . . 104-L to indicate the order in which the corresponding images were collected. The interactive screen 100 may also include a zoom scrollbar 110 and a navigation control 112 to allow the operator to zoom in and out of certain portions of the displayed satellite image 102 and adjust the center of the satellite image 102, respectively. Depending on the implementation, the interactive screen 100 also may include other controls, such as a compass control to select the orientation of the satellite image 102, for example.

In another embodiment, arrows similar to the arrows 106 are used to indicate the orientation of the vehicle at the time when the corresponding image was collected. In yet another embodiment, arrows that indicate the order of the images as well as arrows that indicate the orientation of the vehicle can be displayed in an interactive screen using different styles or colors, for example.

During operation, the operator may select a certain pose run R via an interactive screen (not shown) provided by the pose correction UI component 20, for example. The selection of the pose run R may be based on the date and time when the pose run R took place, the identity of a vehicle used to conduct the pose run R, the identity of the driver of the vehicle, a description of the geographic region in which the pose run R took place, etc. In response to the operator selecting the pose run R, the pose rendering engine 22 (see FIG. 1) or another component may retrieve the pose records 52 that describe poses in the selected pose run R from the image and pose database 12, use the location data 62 in the retrieved pose records 52 to determine a geographic area with which the pose records 52 are generally associated, retrieve the satellite image 102 or another representation of the geographic area, determine where each pose indicator 104-1, 104-2, . . . 104-L should be displayed relative to the background satellite image 102, and display each pose indicator 104-1, 104-2, . . . 104-L in the corresponding location. Depending on the embodiment, pose pictographs 104-1, 104-2, . . . 104-L are displayed for every pose in the pose run R or only for a subset of the poses in the pose run R. For example, to reduce clutter on the interactive screen 100, a respective pose pictograph may be displayed only for every n-th (e.g., fifth, tenth) pose in the pose run R. In general, a pose indicator may be an alphanumeric symbol, a non-textual symbol such as a circle or a triangle, a representative icon, a miniaturization of the photograph corresponding to the pose, or any other type of an indicator. In the example of FIG. 3, each pose indicator 104-1, 104-2, . . . 104-L is a circle.

If pose data includes GPS coordinates, the pose rendering engine 22 may utilize both the surface positioning data, e.g., the latitude and the longitude, and the altitude data. The pose correction UI component 20 accordingly may allow the operator to adjust the position of a pose indicator in three dimensions. Alternatively, the pose rendering engine 22 may utilize only the surface positioning data.

In some embodiments, the pose rendering engine 22 automatically determines the size and/or the zoom level of the satellite image 102 based on the retrieved pose records 52. To this end, in one embodiment, the pose rendering engine 22 identifies which of the poses in the pose run R are at the boundaries of an area that encompasses the entire pose run R. For example, if the satellite image 102 of FIG. 3 is displayed with the common north-at-the-top orientation, the pose corresponding to the pose indicator 104-1 is at the western boundary of the pose run R, the pose corresponding to the pose indicator 104-6 defines the southern and the eastern boundaries of the pose run, and the pose corresponding to the pose indicator 104-9 corresponds to the northern boundary of the pose run. Upon identifying the area that encompasses the entire pose run, the pose rendering engine 22 may select a geographic area that includes at least the identified area (e.g., the identified area and a certain offset in each of the four cardinal directions). In another embodiment, the pose rendering engine 22 determines which of the poses in the pose run R is in the most central position relative to the rest of the pose run R, and centers the satellite image 102 around the most central pose. In yet another embodiment, the pose rendering engine 22 determines the centroid of the poses in the pose run R and centers the satellite image 102 around the determined centroid. Further, in yet another embodiment, the pose correction UI component 20 and/or the pose rendering engine 22 allows the user to select the satellite image 102 prior to selecting the pose run R.

Using a mouse, for example, the operator may point to the pose indicator 104-6, left-click on the pose indicator 104-6, drag the pose indicator 104-6 to a new location, and release the left mouse button. Because the pose indicator 104-6 appears to be on a sidewalk, the operator may move the pose indicator 104-6 to a new location in the street, as schematically illustrated in FIG. 3 using dashed lines. Thus, in this scenario, the operator primarily relies on visual cues to determine where the pose indicator 104-6 should be moved. Moreover, in a scenario that involves collecting images and pose information using a car, the operator typically can assume that a pose indicator displayed in a pedestrian area is incorrect and accordingly requires adjustment.

The pose correction UI component 20 may automatically adjust the length and/or the orientation of the arrows 106 that interconnect the pose indicator 104-6 with the neighbor pose indicators 104-5 and 104-7. Further, the pose correction UI component 20 may forward the position of the pose indicator 104-6 in the interactive screen 100 to the rendering engine 22. In response, the rendering engine 22 and/or the pose correction engine 34 may calculate the new geographic location data, such as a new set of GPS coordinates, of the pose represented by the pose indicator 104-6. However, in some embodiments, the pose correction UI component 20 forwards the new positions of pose indicators to the rendering engine 22 only after a certain number of pose indicators (e.g., three, four, five) have been moved. In another embodiment, the pose correction UI component 20 forwards adjusted or accepted pose data to the rendering engine 22 after the operator activates a certain control provided on the interactive screen 100, such as an "accept" or "submit" button (not shown), for example. Further, in some embodiments, the automatic adjustment of the arrows 106 may be implemented in the pose rendering engine 22 or the pose correction engine 34 rather than, or in addition to, in the pose correction UI component 20.

In a certain embodiment, the pose correction UI component 20 imposes a limit on how far the operator may move a selected pose indicator or otherwise restricts the ability of the operator to correct pose data. For example, if the operator attempts to move the pose indicator 104-6 beyond a certain distance from the original position of the pose indicator 104-6, the pose correction UI component 20 may display a pop-up window (not shown) or another type of a notification advising the operator that the operation is not permitted. Depending on the implementation, the operator may or may not be allowed to override the notification. As another example, the operator may attempt to adjust the position of a pose indicator in the interactive screen 100 so as to modify the order in which the poses appear in the corresponding pose run. Thus, if a modified position of a pose indicator indicates that the corresponding pose now results in different order in the succession of poses, and thus suggests that the vehicle at some point moved in the opposite direction during the pose run, the pose correction UI component 20 may prevent the modification or at least flag the modification as being potentially erroneous.

Further, in some embodiments, the pose correction UI component 20 permits operators to mark certain poses for deletion. An operator may decide that certain pose runs should be partially or fully deleted if, for example, images associated with the poses are of a poor quality, or if the operator cannot determine how pose data should be adjusted. Conversely, an operator may decide that none of the poses in a pose run require correction and accept the currently displayed pose run without any modifications.

In some situations, an operator may wish to view the image (or, when available, multiple images) corresponding to a certain pose indicator prior to moving the pose indicator. For example, referring to an interactive screen 200 illustrated in FIG. 4, the operator may decide that a pose indicator 204-10 probably should be moved, but the operator may not be certain how far the pose indicator 204-10 should be moved. In other situations, an operator may not be certain regarding the direction in which a pose indicator should be moved, or the operator may not be entirely convinced that a certain pose indicator should be moved at all. To provide better guidance to the operator, the pose correction UI component 20 may display a set of images 220 in response to the operator right-clicking on the pose indicator 204-10, for example. In other embodiments, the pose correction UI component 20 may provide other controls (e.g., interactive icons, commands in a toolbar, etc.) to allow the operator to view images associated with pose indicators.

As discussed above with reference to FIG. 2, a pose may be associated with a single image, such as a panoramic photograph, or several images collected at the same location, typically but not necessarily at the same time. The set of images 220 in the example of FIG. 4 includes images 220-1 and 220-2, each of which corresponds to a different orientation of a camera mounted on a vehicle during the pose run represented by the pose indicators 204-1, 204-2, etc. The user may scroll through the set 220 and view several photographs to better estimate a new location of the pose indicator 204-10. However, in some situations, the set 220 includes a single photograph.

Figure 5:
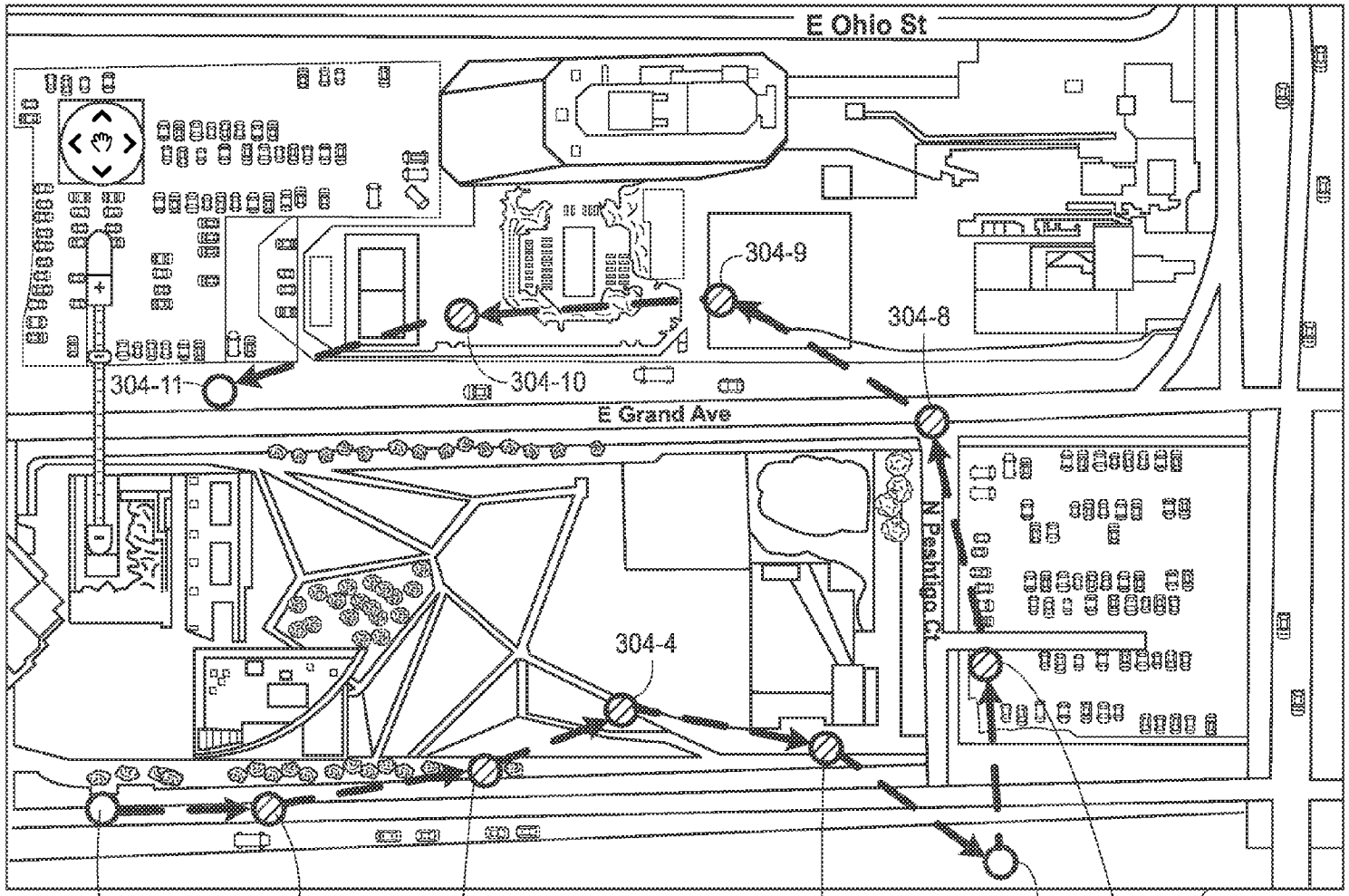
FIG. 5 is another example screenshot of a user interface via which an operator may adjust location data for images using the techniques of the present disclosure.

Now referring to FIG. 5, it may be desirable that the operator review a pose run relatively quickly, particularly if the operator is responsible for a large number of pose runs, each including numerous poses. To expedite pose correction, the pose correction UI component 20 may allow the operator to adjust only non-consecutive poses, or poses separated by no less than N intermediate poses. For example, in an interactive screen 300, pose indicators 304-1, 304-6, and 304-11 are adjustable, but the pose indicators 304-2 through 304-5, as well as the pose indicators 304-7 through 304-11, are not adjustable. Poses that are not adjustable and poses that are adjustable may be represented by different symbols, e.g., circles of two different colors. In an embodiment, the pose correction UI component 20 and/or the pose rendering engine 22 determine whether a particular pose is adjustable based on the proximity of the pose to a pose that is adjustable, so that an operator can adjust only every eighth pose, for example. In various implementation, other factors, such as the minimum spatial separation between two consecutive adjustable poses can be used.

Figure 6:
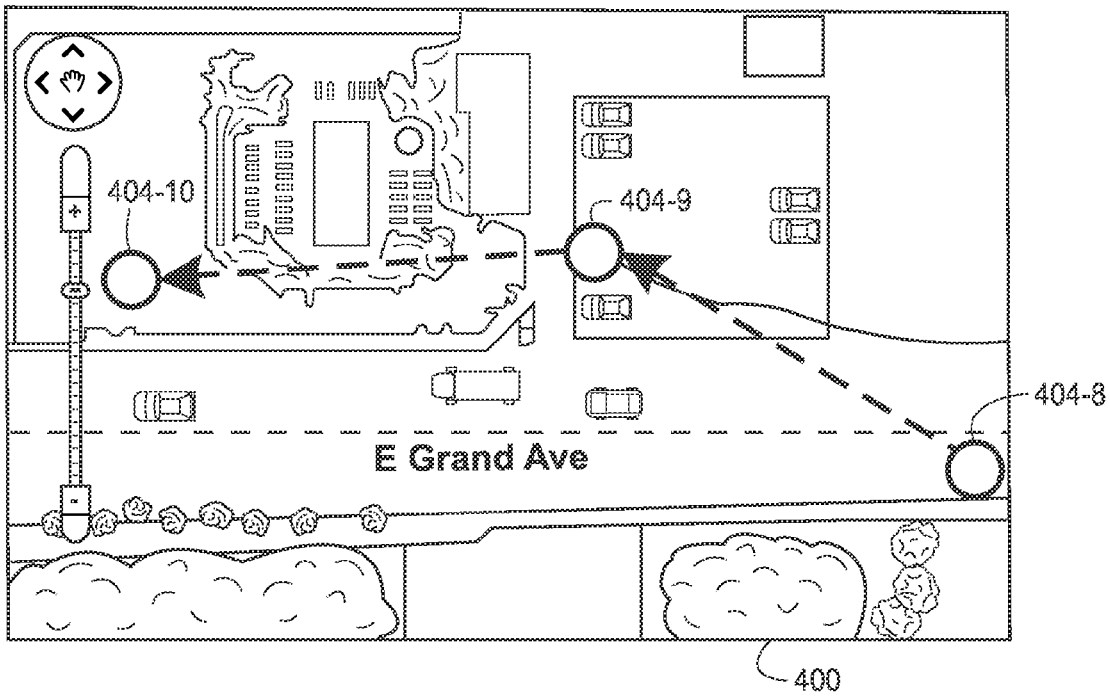
FIG. 6 is an example screenshot of a user interface via which an operator may enlarge a portion of a satellite image and adjust location data for one or more images.

FIG. 6 illustrates an example interactive screen 400 which the pose correction UI component 20 generates by enlarging a selected portion of the interactive screen 100 (see FIG. 3) in response to an operator command. Because the interactive screen 400 provides a more detailed view of the geographic area in which the poses represented by pose indicators 404-8, 404-9, and 404-10 are located, the operator may more precisely adjust the location of one or more of the pose indicators 404-8, 404-9, and 404-10. For example, the operator may move the pose indicator 404-8 from the left lane to the right lane of the road because the enlarged satellite image in the interactive screen 400 appears to show that the road is a two-way divided street. In an embodiment, the pose correction UI component 20 displays road additional information, such as lane assignment (one-way traffic only in all lanes, two lanes in one direction and one lane in the opposite direction, etc.) in response to an operator command or automatically for a certain zoom level, for example.

Figure 7:
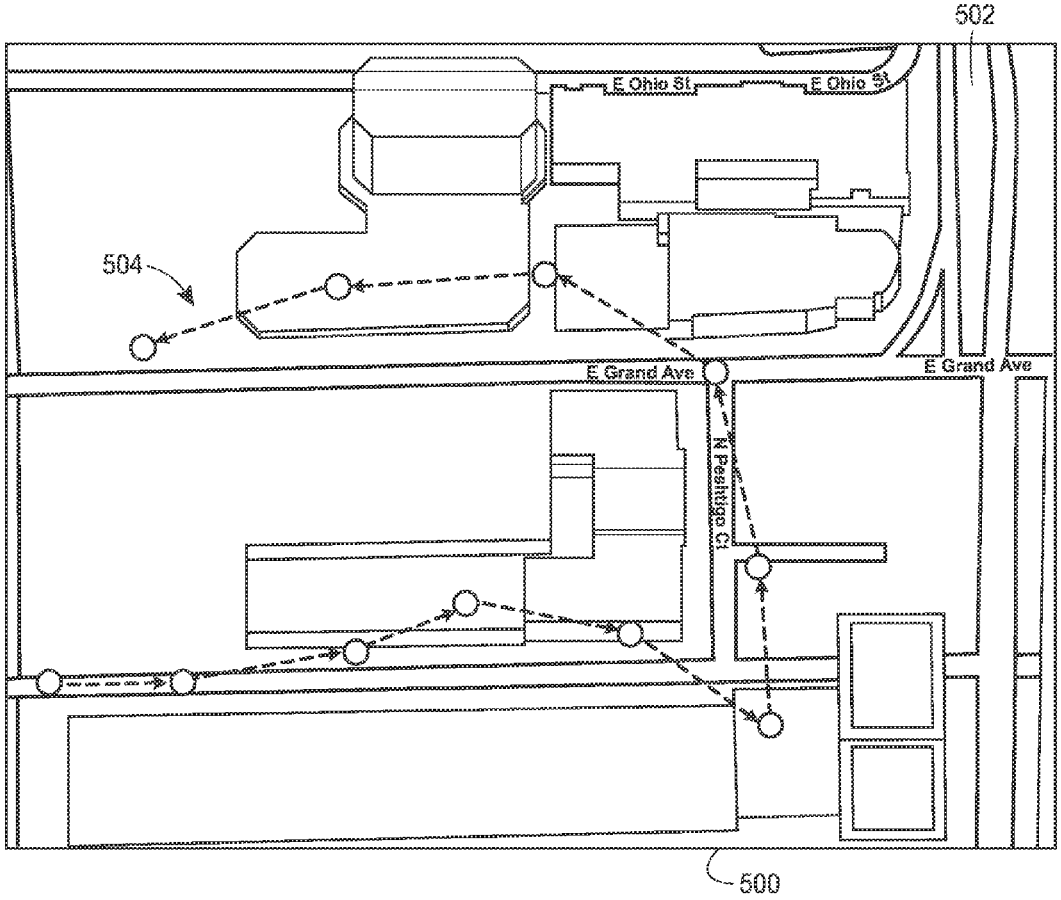
FIG. 7 is another example screenshot of a user interface via which an operator may adjust location data for images using the techniques of the present disclosure.

Although the interactive screens 100, 200, and 300 discussed above utilize satellite imagery to represent a geographic area, the pose rendering engine 22 and/or the pose correction UI component 20 in other embodiments or configurations may render the geographic area as a street map, a topographic map, or any other suitable type of a map. For example, FIG. 7 illustrates an interactive screen 500 that includes a street map 502, displayed in the background, and a series of pose indicators 504, displayed in the foreground. In an embodiment, the operator can switch between a satellite view and a street map view, for example, according to the operator's preference. Generally speaking, the image positioning system 10 may provide interactive screens, similar to the examples illustrated in FIGS. 3-7, that can be configured according to the desired type (e.g., satellite, schematic, topographic), level of detail, color, amount and type of labeling, etc.

In general, the image positioning UI component 20, the pose rendering engine 22 and the pose correction engine 24 may be implemented on dedicated hosts such as personal computers or servers, in a "cloud computing" environment or another distributed computing environment, or in any other suitable manner. The functionality of these and other components of the image positioning system 10 may be distributed among any suitable number of hosts in any desired manner. To this end, the image positioning UI component 20, the pose rendering engine 22, and the pose correction engine 24 may be implemented using software, firmware, hardware, or any combination thereof. To illustrate how the techniques of the present disclosure can be implemented by way of more specific examples, several devices that can be used in the image positioning system 10 are discussed next with reference to FIGS. 8 and 9. Further, another embodiment of an image positioning system, in which multiple operators may verify and adjust image positions via a crowdsourcing server, is discussed with reference to FIG. 11.

Figure 8:
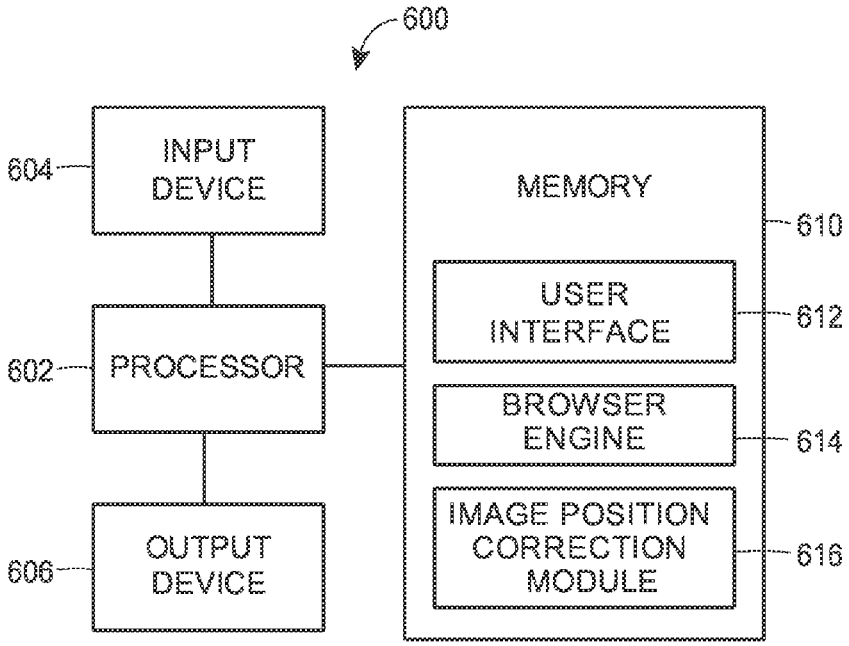
FIG. 8 is a block diagram of an example computing device which an operator can use in the image positioning system of FIG. 1 to correct pose data using the techniques of the present disclosure.

Referring to FIG. 8, a computing device 600 may be used as the computing device 14 in the image positioning system 10, for example. Depending on the embodiment, the computing device 600 may be a workstation, a PC (a desktop computer, a laptop computer, a tablet PC, etc.), a special-purpose device for verifying and adjusting image positioning data in the image positioning system 10, a smartphone, etc. The computing device 600 includes at least one processor 602, one or several input devices 604, one or several output devices 606, and a computer-readable memory 610. In an embodiment, the processor 602 is a general-purpose processor. In another embodiment, the processor 602 includes dedicated circuitry or logic that is permanently configured (e.g., as a special-purpose processor, such as a field programmable gate array (FPGA) or an application-specific integrated circuit (ASIC)) to perform certain operations. The computing device 600 may utilize any suitable operating system (OS) such as Android™, for example. Depending on the embodiment, the input device 604 may include, for example, a mouse, a touchpad, a keyboard, a touchscreen, or a voice input device, and the output device 606 may include a computer monitor, a touchscreen, or another type of a display device.

The memory 610 may be a persistent storage device that stores several computer program modules executable on the processor 602. In an embodiment, the memory 610 may store a user interface module 612, a browser engine 614, an image position correction module 616. During operation of the computing device 600, the user interface module 612 supports the interaction between various computer program modules executable on the processor 602 and the input device 604 as well as the output device 606. In an embodiment, the user interface module 612 is provided as a component of the OS of the computing device 600. Similarly, the browser engine 614 may be provided as a component of the OS or, in another embodiment, as a portion of a browser application executable on the processor 602. The browser engine 614 may support one or several communication schemes, such as TCP/IP and HTTP(S), required to provide communications between the computing device 600 and another device, e.g., a network host.

With continued reference to FIG. 8, the image position correction module 616 implements at least a portion of the functionality of the pose correction UI component 20. Depending on the embodiment, the image position correction module 616 may be a plugin compatible with a browser application that utilizes the browser engine 614, or a standalone application that interacts with the browser engine 614 to communicate with other devices, for example. In operation, the image position correction module 616 may utilize the user interface 612 receive and process operator commands and provide interactive screens similar to those illustrated in FIGS. 3-7 to the operator.

Figure 9:
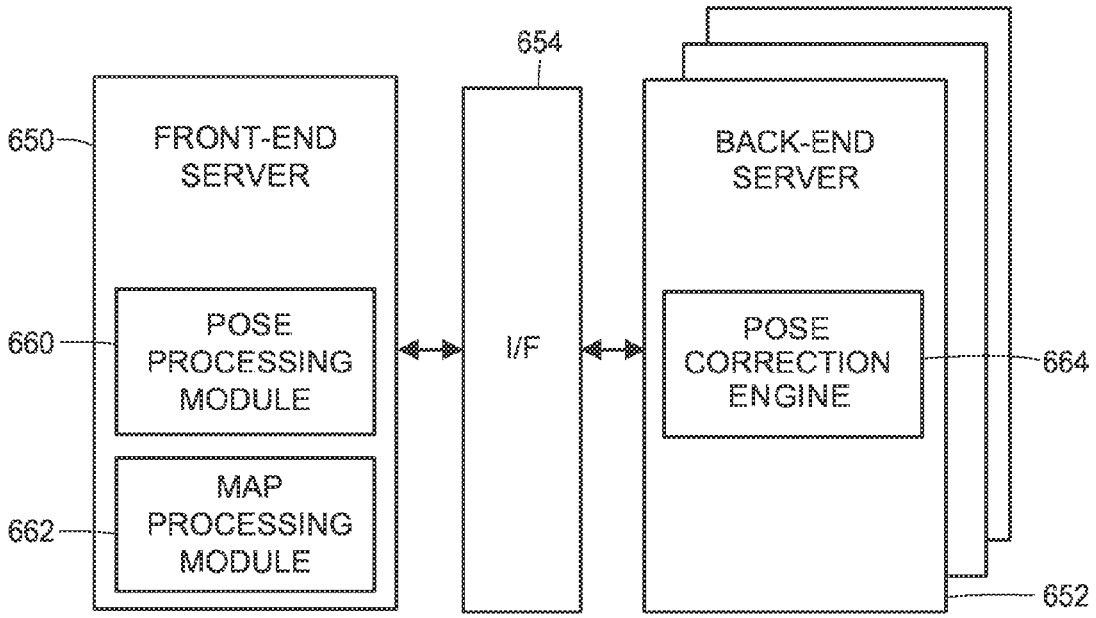
FIG. 9 is a block diagram of an example back-end server and an example front-end server that operate in the image positioning system of FIG. 1 to support the pose correction techniques of the present disclosure.

FIG. 9 illustrates an example front-end server 650 communicatively coupled to a back-end server 652 via a network interface 654, which may include one or more local area networks or wide area networks interconnected in a wired or wireless manner. For example, the servers 650 and 652 may communicate via an Ethernet link. Each of the front-end server 650 and the back-end server 652 may have any suitable hardware and software architecture. For example, the servers 650 and 652 may include one or several processors, network interface modules (e.g., one or several network cards), computer-readable memory modules to store computer programs executable on the corresponding processors (none shown), etc. To better balance the distribution of various computing tasks, the front-end server 650 in some implementations interacts with multiple back-end servers 652. For example, the front-end server 650 may select a back-end server from among several back-end servers 652 based on the processing power available at each server. Further, in an embodiment, some or all back-end servers 652 also interact with multiple front-end servers 650.

The front-end server 650 may execute a pose processing module 660 and a map processing module 662 to retrieve, render, and position foreground pose data and background map data, respectively. Referring back to FIG. 2, the modules 660 and 662 may be components of the pose rendering engine 660. The back-end server 664 may include a pose correction engine 664. In an embodiment, the pose correction engine 664 operates as the pose correction engine 34.

Figure 10:
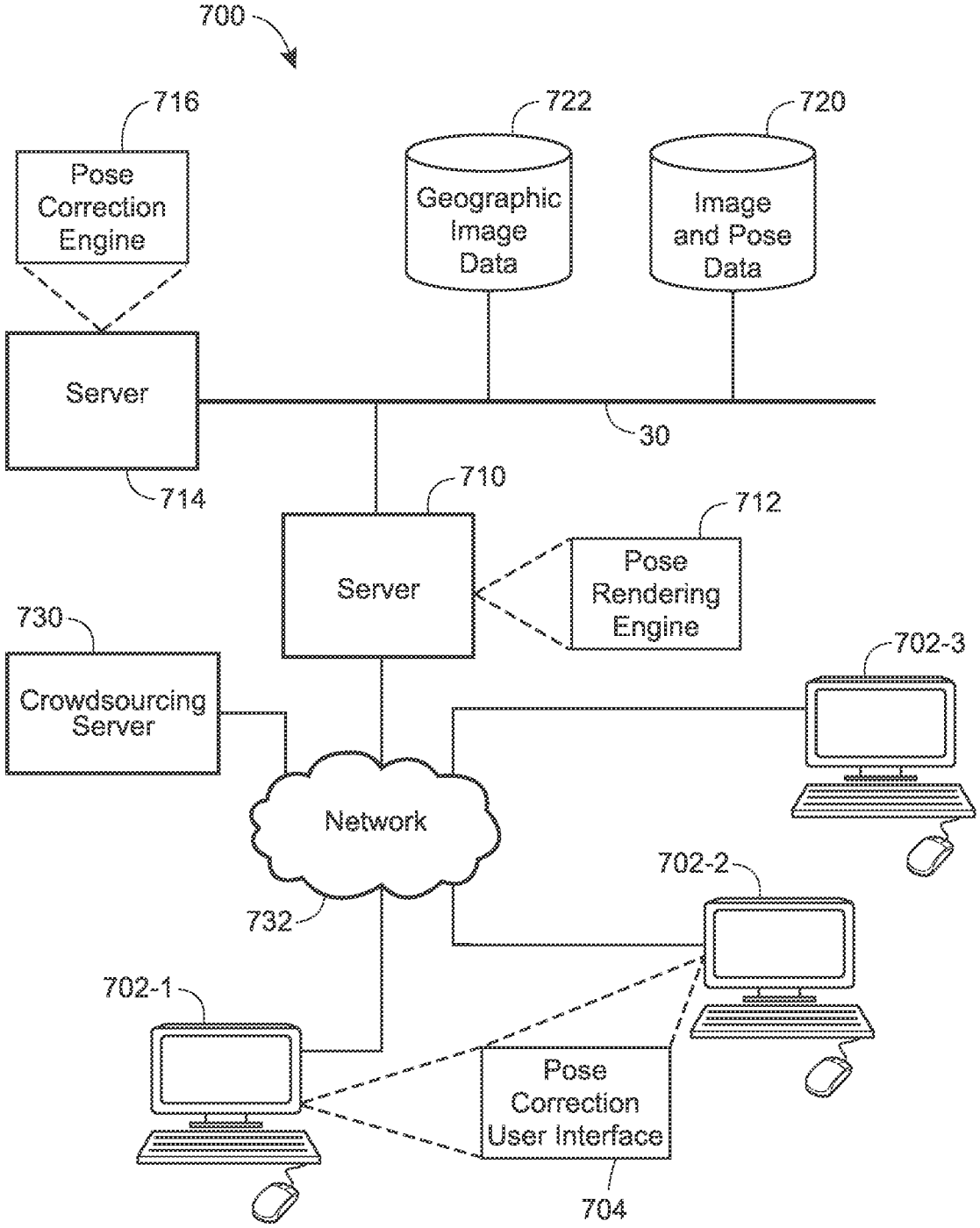
FIG. 10 is a block diagram of an image positioning system in which a crowdsourcing server is utilized to implement the pose correction techniques of the present disclosure.

Now referring to FIG. 10, an example image positioning system 700 includes several computing devices 702-1, 702-2, and 702-3, each of which implements a pose correction UI component 704, a front-end server 710 that implements a pose rendering engine 712, a back-end server 714 that implements a pose correction engine 716, an image and pose database 720, and a geographic image database 722. A crowdsourcing server 730 is coupled to the computing devices 702-1, 702-2, and 702-3 and the servers 714 and 716 via a network 732 to allow a greater number of human operators to participate in verification and correction of pose data.

In general, the crowdsourcing server 730 uses human operators to verify and, when necessary, correct image positioning in the image positioning system 700. The crowdsourcing server 730 receives human intelligence tasks (HITs) to be completed by operators using the computing devices 702-1, 702-2, and 702-3. In particular, the HITs specify pose runs stored in the image and pose database 720 that require verification correction. The crowdsourcing server 730 may support one or several application programming interface functions (APIs) to allow a requestor, such as an administrator responsible for the image and pose database 720, to specify how a HIT is to be completed. For example, the HIT may automatically link an operator that uses the computing devices 702-1 to a site from which the necessary plugin or application (e.g., the image position correction module 616 of FIG. 8) can be downloaded, specify which pose runs are available for verification, and list various other conditions for completing a pose run verification task. In an embodiment, the crowdsourcing server 730 receives a HIT that specifies multiple pose runs, automatically distributes the pose runs among several computing devices, and manages the status of the tasks assigned to the computing devices. Further, according to an embodiment, the crowdsourcing server 730 receives pose data corresponding to one or several pose runs for each HIT. For example, the back-end server 714 may retrieve a set of pose data records from the image and pose database 720, forward the retrieved set to the crowdsourcing server 730 and, upon completion of the corresponding task at the crowdsourcing server 730, receive the updated set of pose data from the crowdsourcing server 730. The back-end server 714 may then update the image and pose database 720.

Further, the crowdsourcing server 730, alone or in cooperation with the servers 712 and 714, may automatically determine whether particular operators are qualified for pose run verification. For example, when a candidate operator requests that a certain pose verification task be assigned to her, a component in the image positioning system 700 may request that the operator provide her residence information (e.g., city and state in which she lives), compare the geographic area with which the pose run is associated to the candidate operator's residence information, and determine whether the operator is likely to be familiar with the geographic area. Additionally or alternatively, the image positioning system 700 may check the candidate operator's age, his prior experience completing image positioning tasks, etc. The back-end server 714 or another component of the image positioning system 700 may periodically poll the crowdsourcing server 730 to determine which HITs are completed. In an embodiment, the crowdsourcing server 730 operates as a component in the Mechanical Turk system from Amazon.com, Inc.

Several example methods that may be implemented by the components discussed above are discussed next with reference to FIGS. 11-13. As one example, the methods of FIGS. 11-13 may be implemented as computer programs stored on the tangible, non-transitory computer-readable medium (such as one or several hard disk drives) and executable on one or several processors. Although the methods of FIGS. 11-13 can be executed on individual computers, such as servers or PCs, it is also possible to implement at least some of these methods in a distributed manner using several computers, e.g., using a cloud computing environment.

Figure 11:
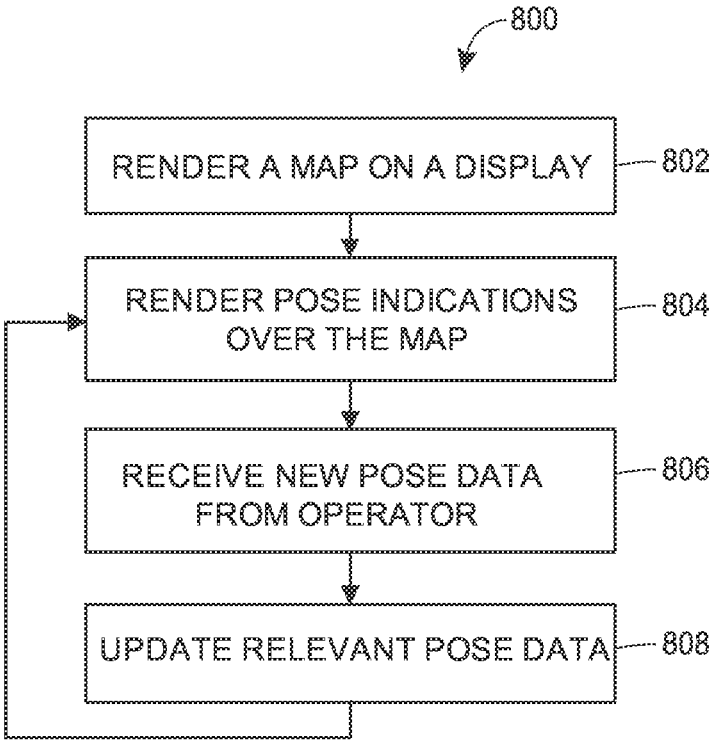
FIG. 11 is a flow diagram of an example method for correcting pose data.

FIG. 11 is a flow diagram of an example method 800 for correcting pose data, according to an embodiment. The method 800 may be implemented in the pose correction UI component 20 in the computing device 14 (see FIG. 1) or the computing devices 702-1, 702-2, and 702-3, for example. In an embodiment, the pose correction UI component 20 and/or the pose correction UI component 704 includes the method 800 as a feature. At block 802, a map is rendered in an interactive screen on a display of a computing device.

Depending on the implementation or configuration, another visual representation of a geographic area, such as a satellite image, may be rendered instead of the map. It is also possible to render a hybrid view of the geographic area, such as a satellite image with map data (road labels, municipal or state boundaries, etc.). In an embodiment, the pose rendering engine 22 or 712 generates the map as a raster image or vector data, forwards the raster image or the vector data to the pose correction UI component 20 or 704, and the pose correction UI component 20 or 704 renders the raster image or the vector data on the display.

At block 804, visual pose indications are rendered in the interactive screen over the map or other visual representation of the geographic area generated at block 802. For example, pose indications may be pose indicators that are superimposed on the map in accordance with the corresponding location data. The pose indicators may define an upper layer in the interactive visualization, and the map may define a lower layer in the interactive visualization. In this manner, the pose correction UI component 20 or 704 can easily re-render pose indicators in response to operator commands while keeping the background map image static. In some embodiments, the pose rendering engine 22 or 712 generates the pose indicators as a raster image, forwards the raster image to the pose correction UI component 20 or 704, and the pose correction UI component 20 or 704 renders the raster image on the display. In one such embodiment, the pose rendering engine 22 or 712 generates a raster image that includes both the map data and the pose indicators. In another embodiment, the pose correction UI component 20 or 704 receives a map image from the pose rendering engine 22 or 712, superimposes pose indicators onto the received map image, and renders the resulting image on the display.

At block 806, pose corrections (or adjustments) are received from the operator. For example, the operator may use a pointing device, such as a mouse or a touchpad, to select a pose indicator and move the pose indicator to a new position in the interactive screen. The operating system may process several events received from the pointing device and forward the processed events to the pose correction UI component 20 or 704. If needed, the operator may adjust multiple poses at block 806. Next, at block 808, pose data is updated in accordance with the adjusted positions of the corresponding pose indicators. According to an embodiment, the operator activates a control in the interactive screen (e.g., a "submit" button) to trigger an update of the appropriate records in the image and pose database 12 or 720. In another embodiment, the image and pose database 12 or 720 is updated after the operator adjusts a certain number of poses. In yet another embodiment, the image and pose database 12 or 720 is updated periodically, e.g., once every two minutes. Once pose data is updated at block 808, the flow returns to block 804, unless the operator terminates the method 800.

Figure 12:
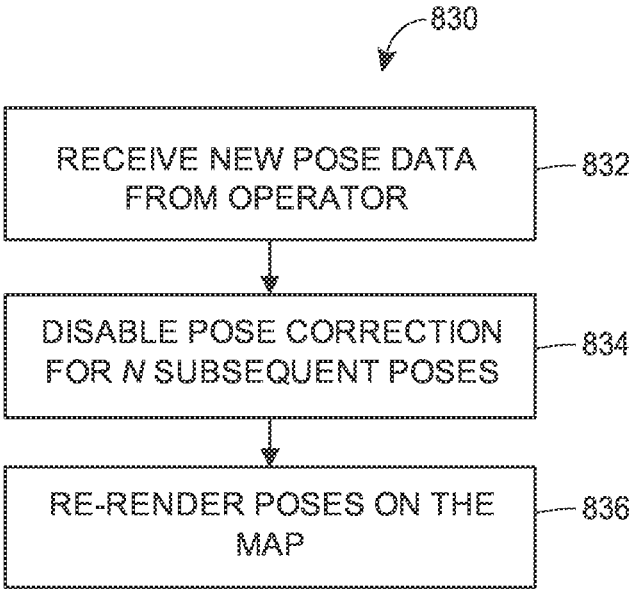
FIG. 12 is a flow diagram of an example method for receiving pose correction data from a user interface.

FIG. 12 is a flow diagram of an example method 830 for receiving adjusted pose data from an operator. The method 800 may be implemented in the pose rendering engine 712, the pose correction UI component 20 or 704, or implemented partially in the pose rendering engine 712 and partially in the pose correction UI component 20 or 704, for example. In an embodiment, the method 800 is executed at block 806 discussed with reference to FIG. 11.

At block 832, an adjusted pose, e.g., a new position of a pose indicator in an interactive screen, is received from an operator via an interactive screen. In response, at block 834, the pose correction UI component 20 or 704 may disable pose correction for N (e.g., five, ten) subsequent poses to prevent the operator from attempting to move every pose that appears to be incorrect. The poses for which correction is disabled may be selected along the direction in which the corresponding pose run progresses or along both directions, depending on the implementation. In an embodiment, the number N is configurable. To indicate that the N poses subsequent or adjacent to the adjusted pose cannot be modified, the corresponding pose indicators may be rendered using a different color, a different pictogram or symbol, or in any other manner. At block 836, a pose indicator corresponding to the adjusted pose, as well as pose indicators corresponding to the poses for which correction is disabled, are rendered in the appropriate positions in the interactive screen.

Figure 13:
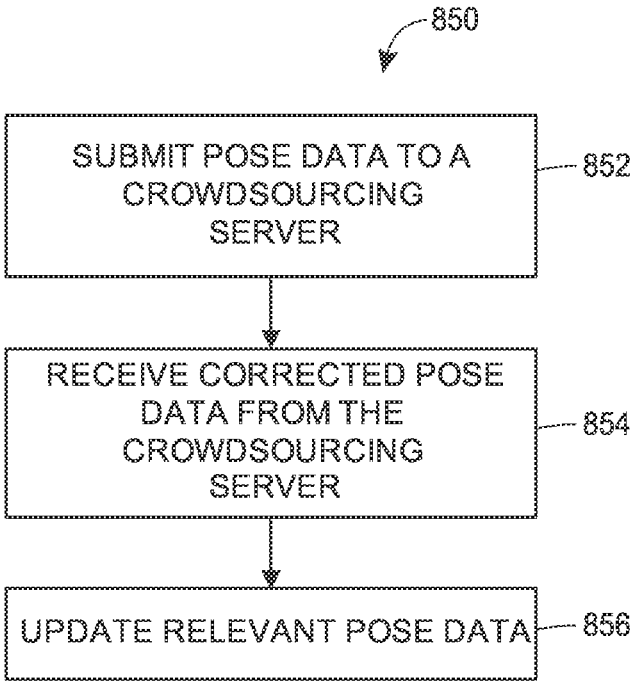
FIG. 13 is a flow diagram of an example method for correcting pose data using a crowdsourcing server.

FIG. 13 is a flow diagram of an example method 850 for correcting pose data using a crowdsourcing server that can be implemented, for example, in the back-end server 714 (see FIG. 10). At block 852, pose data corresponding to one or several pose runs is submitted to a crowdsourcing server. After the submitted pose data is processed and corrected, updated pose data is received from the crowdsourcing server at block 854. At block 856, the received pose data is applied to a database, such as the image and pose database 720, for example.

The following additional considerations apply to the foregoing discussion. Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of components, modules, or mechanisms. Modules may constitute either software modules (e.g., code embodied on a machine-readable medium or in a transmission signal) or hardware modules. A hardware module is tangible unit capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as a hardware module that operates to perform certain operations as described herein.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and a process for correcting pose image data through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A computer-implemented method for correcting image pose data stored on a computer-readable medium, wherein the image pose data includes geographic location data for each of a plurality of images, the image pose data and the plurality of images obtained during a single pose run, the method comprising:

causing a representation of a geographic area to be displayed on a display device;

determining a position of each of a plurality of pose indicators relative to the representation of the geographic area based on the geographic location data, wherein the pose indicators correspond to the single pose run and each of the plurality pose indicators corresponds to one of the plurality of images;

causing the plurality of pose indicators corresponding to the single pose run to be displayed over the representation of the geographic area on the display in accordance with the determined positions;

receiving an indication of a modified position of a selected pose indicator within the displayed single pose run, wherein the modified position is modified relative to the representation of the geographic area on the display device;

determining corrected geographic location data for the image corresponding to the selected pose indicator based on the received indication of the modified position; and modifying the image pose data in accordance with the corrected geographic location data;

wherein the single pose run describes a trajectory of a device that obtained the image pose data and the corresponding plurality of images.

2. The method of claim 1, wherein the representation of the geographic area includes satellite imagery.

3. The method of claim 1, wherein the image pose data includes global positioning service (GPS) coordinates to indicate the geographic locations.

4. The method of claim 1, wherein the image pose data further indicates an order in which the plurality of images were obtained within the single pose run.

5. The method of claim 4, wherein the image pose data includes one of a unique sequence number or a timestamp for each of the plurality of images to indicate the order in which the plurality of images were obtained within the single pose run.

6. The method of claim 4, further comprising causing a plurality of arrows to be displayed over the representation of the geographic area, wherein the plurality of arrows interconnect the plurality of pose indicators according to the order indicated in the image pose data within the single pose run.

7. The method of claim 1, wherein causing the plurality of pose indicators to be displayed includes:

causing the selected one of the plurality of pose indicators to be displayed as an indicator of a first type to indicate that the position of the selected one of the plurality of pose indicators relative to the representation of the geographic area can be adjusted; and in response to receiving the indication of the modified position of the selected one of the plurality of pose indicators, causing N of the plurality of pose indicators to be displayed as indicators of a second type to indicate that the position of the corresponding pose indicators relative to the representation of the geographic area cannot be adjusted.

8. The method of claim 1, further comprising:

in response to an operator command, causing one of the plurality of images that corresponds to the selected one of the plurality of pose indicators to be displayed on the display device.

9. The method of claim 1, wherein the representation of the geographic area to be displayed on the display device includes road map data.

10. The method of claim 1, wherein the plurality of images were obtained during the single pose run using a vehicle on which at least one camera is mounted.

11. The method of claim 10, further comprising causing a plurality of arrows to be displayed over the representation of the geographic area, wherein:

each of the plurality of arrows corresponds to a respective one of the plurality of images; and each of the plurality of arrows indicates an orientation of the vehicle at a time when the corresponding one of the plurality of images was obtained.

12. An image pose data correction system comprising:

a database to store a plurality of pose records, wherein each of the plurality of pose records includes an image and pose data, wherein the pose data includes geographic location data for a geographic location at which the image was obtained, and the image and geographic location data for each pose record were obtained during a single pose run;

a pose rendering engine communicatively coupled to the database and configured to:

generate a representation of a geographic area to be displayed at a client device, determine a position of each of a plurality of pose indicators relative to the representation of the geographic area based on the geographic location data, wherein the pose indicators correspond to a single pose run and each of the pose indicators corresponds to an image, and generate a representation of the plurality of pose indicators corresponding to the single pose run to be displayed over the representation of the geographic area at the client device in accordance with the determined positions; and a pose calculation engine configured to:

in response to receiving a user-modified position of a selected pose indicator within the displayed single pose run, determine corrected geographic location data for the image corresponding to the selected pose indicator based on the modified position of the selected pose indicator, wherein the modified position is modified relative to the representation of the geographic area at the client device, and modify the pose record in accordance with the corrected geographic location;

wherein the single pose run describes a trajectory of a device that obtained the image and pose data.

13. The image processing system of claim 12, further comprising:

a pose correction user interface module to be installed on the client device and configured to:

display the representation of the geographic area on a display device;

display the representation of the plurality of pose indicators on the display device within the single pose run; and receive the modified position of the selected one of the plurality of pose indicators from an input device.

14. The image positioning system of claim 12, wherein:

the pose rendering engine operates in a front-end server, wherein the front-end server is coupled to the client device via a first network connection, and the pose calculation engine operates in a back-end server communicatively coupled to the front-end server via a second network connection.

15. The image positioning system of claim 14, wherein the back-end server receives the modified position from a crowd-sourcing server from one or more client devices.

16. The image positioning system of claim 12, wherein each of the plurality of pose records further includes an indication of a time at which the image was obtained.

17. The image positioning system of claim 12, wherein the representation of the geographic area includes at least one of satellite imagery and a street map.

18. The image positioning system of claim 12, wherein each of the plurality of pose records includes global positioning service (GPS) coordinates to indicate the geographic locations.

19. A tangible non-transitory computer-readable medium having instructions stored thereon that, when executed by one or more processors, cause the one or more processors to:

cause a representation of a geographic area to be displayed on a display device;

determine a position of each of a plurality of pose indicators relative to the representation of the geographic area based on the geographic location data, wherein the pose indicators correspond to a single pose run and each of the plurality pose indicators corresponds to one of the plurality of images;

cause the plurality of pose indicators corresponding to the single pose run to be displayed over the representation of the geographic area on the display in accordance with the determined positions;

receive a modified position of a selected pose indicator within the displayed single pose run, wherein the modified position is modified relative to the representation of the geographic area on the display device;

determine corrected geographic location data for the image corresponding to the selected pose indicator based on the received indication of the modified position; and modify the image pose data in accordance with the corrected geographic location data;

wherein the single pose run describes a trajectory of a device that obtained the image pose data and the corresponding plurality of images.

20. The computer-readable medium of claim 19, wherein:

the image pose data further indicates an order in which the plurality of images were obtained within the single pose run; and the instructions further cause the one or more processors to cause a plurality of arrows to be displayed over the representation of the geographic area, wherein the plurality of arrows interconnect the plurality of pose indicators according to the order indicated in the image pose data within the single pose run.

21. The computer-readable medium of claim 19, wherein the representation of the geographic area includes satellite imagery.

* * * * *